United States Patent [19]

Duhl et al.

[11] Patent Number: 4,888,069

[45] Date of Patent: Dec. 19, 1989

[54] NICKEL BASE SUPERALLOYS HAVING LOW CHROMIUM AND COBALT CONTENTS

[75] Inventors: David N. Duhl, Newington; Stephen Chin, Wallingford, both of Conn.

[73] Assignee: United Technologies Corporation, Hartford, Conn.

[21] Appl. No.: 794,024

[22] Filed: Nov. 1, 1985

[51] Int. Cl.[4] ..... C22C 19/03

[52] U.S. Cl. ..... 148/404; 148/409; 148/410

[58] Field of Search ..... 148/404, 409, 410, 427–429; 420/445–450, 460

[56] References Cited

U.S. PATENT DOCUMENTS 4,292,076 9/1981 Gigliotti et al. ..... 148/404

*Primary Examiner*—Richard Dean

[57] ABSTRACT

Single crystal nickel base superalloys, having low chromium and cobalt contents are described. The alloys have a unique combination of aluminum, tantalum, and rhenium, which results in surprisingly good oxidation and corrosion resistance, and a melting point in excess of 2500° F. The properties of the alloys of the present invention make them suitable for use as components in the high temperature section of gas turbine engines.

6 Claims, No Drawings

NICKEL BASE SUPERALLOYS HAVING LOW CHROMIUM AND COBALT CONTENTS

TECHNICAL FIELD

This invention relates to nickel base superalloys, and in particular, to oxidation and corrosion resistant nickel base superalloys for use at elevated temperatures in gas turbine engines.

BACKGROUND ART

Nickel base superalloys have been extensively investigated for many years, and there are many patents which describe various alloy compositions. See, for example, U.S. Pat. No. 4,402,772 and the patents discussed therein.

In U.S. Pat. No. 4,402,772, it is stated that nickel base superalloys typically contain chromium in levels of about 5–15 weight percent, primarily for oxidation resistance; additionally it is stated that nickel base superalloys typically contain cobalt in levels of about 5–15 weight percent.

One example of a nickel base superalloy having a composition outside of the typical range of U.S. Pat. No. 4,402,772 is a cobalt free nickel base superalloy, described in U.S. Pat. No. 4,222,794. Its nominal composition, on a weight percent basis, is 5.2 Cr, 5.4 Al, 1.1 Ti, 2.0 Mo, 4.9 W, 6.4 Ta, 3.0 Re, 0.4 V, with the balance Ni. U.S. Pat. No. 4,116,723 describes a cobalt free nickel base superalloy whose nominal composition is 9 Cr, 5 Al, 2 Ti, 12 W, 1 Cb, with the balance nickel.

U.S. Pat. No. 4,055,447 describes a chromium free nickel base superalloy. The alloy has aligned gamma prime $Ni_3Al$ reinforcing fibers to enhance its strength. The alloy composition is, on a weight percent basis, 6–9 Al, 5–11 Ta, 0–10 Co, 0–6 V, 0–6 Re, 2–6 W, with the balance nickel. The sum of the atomic percentages of (Al+Ta) must be within the range of 19–22, and the ratio of the atomic percentages of Ta: (Al+Ta) must be within the range of 0.12–0.23.

U.S. Pat. No. 4,045,255 describes a chromium free nickel base superalloy which contains aligned NiAl reinforcing fibers. The broadest alloy composition is, on a weight percent basis, 8.5–14.5 Al, 5–15 W, 0–35 Co, with the balance nickel. The alloy optionally contains up to 0.5 Y, up to 3 Ta, and up to 4.5 Re in substitution for a portion of W.

U.S. Pat. No. 4,292,076 describes a chromium free nickel base superalloy which contains aligned carbide reinforcing fibers. The broadest alloy composition is, on a weight percent basis, 0–10 Al, 3–15 Ta, 0–20 Co, 0–20 Cr, 0–7 V, 0–9 Re, 0–20 W, 0–10 Mo, 0–0.8 Ti, 0.1–1 C, 0–3 Cb, 0–3 Hf, 0–1.5 Zr, with the balance Ni.

U.S. Pat. No. 3,793,010 describes a nickel base superalloy which contains aligned delta $Ni_3$(Cb, Ta) fibers. One preferred composition is, on a weight percent basis, 73 Ni, 21 Cb, 6 Cr. Another composition is 68 Ni, 21 Cb, 9 Cr, 2 Al.

DISCLOSURE OF THE INVENTION

This invention relates to superalloys suited for use at elevated temperatures, and in particular, to nickel base superalloys used at elevated temperatures in gas turbine engines. The superalloys of the present invention are characterized by unusually low chromium and cobalt contents compared to many currently used nickel based superalloys. Two preferred alloys contain no chromium or cobalt. Contrary to the teachings of the prior art, the alloys exhibit surprisingly good hot corrosion and oxidation resistance in the absence of chromium. Laboratory tests have shown that the hot corrosion and oxidation resistance of the alloys of the present invention are comparable to, or better than, alloys currently used in gas turbine engines. Laboratory tests have also shown that the alloys have a melting point in excess of 2,500° F.

The composition of the alloys of the present invention is, on a weight percent basis, 4.5–5.5 Al, 3.5–6.5 Re, 13–17 Ta, 0.0–0.5 Hf, with the balance nickel. The alloys may contain up to about 1 weight percent of cobalt and chromium, as well as minor additions of Ti, W, and Mo. The alloys contain no intentional additions of the elements B, Zr, Cb, or C although these elements may be present in small amounts.

Preferably, the alloys are cast into single crystal form by known casting techniques, and are then homogenized at an elevated temperature followed by an aging treatment at a lower temperature.

The foregoing and other objects, features and advantages of the present invention will become more apparent in the light of the following detailed description of the preferred embodiments thereof.

BEST MODE FOR CARRYING OUT THE INVENTION

The present invention relates to nickel base superalloys which have unique and unexpected properties in view of their composition. These properties make them appropriate for use as airfoils in a gas turbine engine. Two preferred embodiments of the present invention contain no intentional additions of Cr and Co. Even in the absence of Cr, the alloys exhibit good resistance to hot corrosion and oxidation degradation. The alloys have been shown to have melting points greater than 2,500° F., and are microstructurally stable at temperatures up to at least 2,000° F. It is preferred that the alloys are cast into a single crystal, using techniques well known in the art. The low Cr and Co content of these alloys is desirable, as both elements are considered strategic, and it is important to minimize the use of such elements which are not readily available in the United States.

Table I presents the composition, in weight percent, of the alloys of the present invention. A broad composition range is given, as well as the composition of two specific embodiments of the present invention, hereinafter referred to as Alloy 610 and Alloy 610A. The compositions of three nickel base superalloys which are commercially used in gas turbine engines are presented in Table I for comparison with the alloys of the present invention. PWA 1422 has a columnar grain microstructure, PWA 1480 has a single crystal microstructure, and PWA 1455 is characterized by an equiaxed crystal microstructure.

TABLE I

| | ALLOY COMPOSITIONS (Weight Percent) | | | | | |
|---|---|---|---|---|---|---|
| | Invention | | | Prior Art | | |
| Element | Broad | Alloy 610 | Alloy 610A | PWA 1422 | PWA 1480 | PWA 1455 |
| Ni | Balance | Balance | Balance | Balance | Balance | Balance |

TABLE I-continued

| | ALLOY COMPOSITIONS (Weight Percent) | | | | | |
|---|---|---|---|---|---|---|
| | Invention | | | Prior Art | | |
| Element | Broad | Alloy 610 | Alloy 610A | PWA 1422 | PWA 1480 | PWA 1455 |
| Al | 4.5–5.5 | 5.4 | 5.0 | 5.0 | 5.0 | 6.0 |
| Re | 3.5–6.5 | 4.0 | 5.9 | 0.0 | 0.0 | 0.0 |
| Ta | 13–17 | 16.2 | 14.1 | 0.0 | 12.0 | 4.3 |
| Hf | 0.0–0.5 | 0.0 | 0.08 | 2.0 | 0.0 | 1.15 |
| Cr | 0.0–1.0 | 0.0 | 0.0 | 9.0 | 10.0 | 8.0 |
| Co | 0.0–1.0 | 0.0 | 0.0 | 10.0 | 5.0 | 10.0 |
| Ti | 0.0–0.2 | 0.0 | 0.0 | 2.0 | 1.5 | 1.0 |
| W | 0.0–1.0 | 0.0 | 0.0 | 12.0 | 4.0 | 0.0 |
| Mo | 0.0–0.2 | 0.0 | 0.0 | 0.0 | 0.0 | 6.0 |
| B | 0.0–0.01 | 0.0 | 0.0 | 0.015 | 0.0 | 0.015 |
| Zr | 0.0–0.01 | 0.0 | 0.0 | 0.0 | 0.0 | 0.08 |
| Cb | 0.0–0.2 | 0.0 | 0.0 | 1.0 | 0.0 | 0.0 |
| C | 0.0–0.05 | 0.0 | 0.0 | 0.1 | 0.0 | 0.1 |

Laboratory tests were conducted to compare the properties of Alloys 610 and 610A with these three currently used alloys. Results of these tests are discussed below.

A limiting factor in the use of superalloys in gas turbine engines is oxidation and hot corrosion degradation. Such attack is caused by the extremely harsh environment of the engine. While most superalloys have coatings applied thereto to limit oxidation and hot corrosion degradation, engine designers have long realized that a substrate material having no resistance to environmental attack will not be useful in gas turbine engines. Thus, the composition of superalloys is tailored to provide a desireable combination of mechanical properties and inherent resistance to adverse environmental attack.

To determine the uncoated hot corrosion resistance of the alloys of the present invention, cyclic and furnace (i.e., isothermal) hot corrosion tests were performed. During cyclic hot corrosion tests, specimens were heated by a flame produced by the combustion of jet fuel for two minutes at 1,750° F., followed by two minutes at 2,000° F., followed by two minutes of forced air cooling. This temperature exposure sequence was continued until a predetermined amount of hot corrosion degradation was detected on the test specimen. To promote hot corrosion attack, 35 parts per million of synthetic sea salt was added to the test environment. In the furnace hot corrosion tests, conducted at a constant temperature of 1650° F., the specimens were coated with 1 milligram per square centimeter of $Na_2SO_4$ to accelerate hot corrosion attack.

During both the cyclic and isothermal hot corrosion tests, the relative performance of the alloys was determined by comparing the number of hours to cause corrosion in the substrate to a depth of 0.001 inches (1 mil). As shown in Table II, in the cyclic hot corrosion tests, the hot corrosion resistance of Alloy 610 was at least four times better than that of PWA 1422. In the isothermal furnace hot corrosion tests, Alloy 610 and the alloy PWA 1422 had similar lives.

TABLE II

| | Hot Corrosion Test Results | |
|---|---|---|
| Alloy | Cyclic Test Resistance (Hrs/mil) | Isothermal Test Resistance (Hrs/mil) |
| Alloy 610 | 8 | 15.2 |
| PWA 1422 | 1.8 | 15.6 |

While no hot corrosion tests were conducted on Alloy 610A, it is believed that this alloy will exhibit hot corrosion resistance which is similar to that of Alloy 610A, based on the compositional similarity between the two alloys 610 and 610A.

Oxidation resistance was measured in cyclic tests. Oxidation lives were measured in terms of the number of hours to cause one mil of oxidation degradation in the substrate. Uncoated specimens of Alloy 610A were cyclicly heated by a flame produced by the combustion of jet fuel for 55 minutes at 2,150° F. and then cooled by forced air for five minutes; uncoated specimens of Alloy 610 were cyclicly heated to 2100° F. for 55 minutes and then cooled by forced air for 5 minutes. As shown in Table III, Alloy 610A had more than four times the oxidation resistance of alloy PWA 1455. Table III also indicates that Alloy 610 had about three times the oxidation resistance of alloy PWA 1422 and about 50% of the oxidation resistance of alloy PWA 1480.

TABLE III

| | Oxidation Test Results |
|---|---|
| Alloy | Cyclic Test Resistance (Hrs/mil) |
| Alloy 610A | 32.7 |
| PWA 1455 | 7.9 |
| Alloy 610 | 18 |
| PWA 1422 | 6 |
| PWA 1480 | 40 |

During similar tests conducted in another alloy development program, it was determined that PWA 1480 had approximately the same oxidation resistance as PWA 1455, and that both alloys, PWA 1480 and PWA 1455, had superior oxidation resistance compared to PWA 1422. Thus, Alloy 610A has better oxidation resistance than all three of these currently used nickel base superalloys, while Alloy 610 has better oxidation resistance than one of these nickel base superalloys. It should be reiterated that all of the above discussed tests results are for uncoated alloys. If used in gas turbine engines, these alloys would be protected by a coating for optimum oxidation and hot corrosion protection. One of the most useful of these coatings is the NiCoCrAlY overlay described in U.S. Pat. No. 3,928,026.

The superalloys are a class of materials which exhibit desirable physical properties at high temperatures. As a result, they have been used in numerous applications in gas turbine engines. Such applications require that the alloy exhibit microstructural stability at elevated temperatures. Turbine airfoils are commonly exposed to temperatures of about 2,000° F.; in some applications, exposure to even higher temperatures occurs. To examine the microstructural stability of the alloys of the present invention, tests were conducted to evaluate their behavior when exposed to elevated temperatures for periods up to 500 hours. Metallographic examination of test specimens after exposure for 500 hours at temperatures of 1,600°, 1,800°, and 2,000° F. indicated that there was little or no precipitation of undesirable phases such as sigma, mu, or Laves, which could degrade physical properties during elevated temperature exposure. This indicates that the alloys are stable, and may be used as turbine airfoil materials.

As noted above, the alloys of the present invention are preferably cast into single crystals using technology known in the art. One such single crystal casting technique is described in U.S. Pat. No. 3,494,709, which is incorporated by reference. In single crystal alloys, strengthening is primarily due to the distribution of the intermetallic gamma prime phase within the solid solution gamma phase matrix. In the alloys of the present invention, the gamma prime phase is of the general formula $Ni_3(Al,Ta)$. For a constant volume fraction of gamma prime, considerable variations in strength may be obtained by varying the size and morphology of the gamma prime precipitate within the gamma matrix. These variations are achieved by heat treating the alloys to dissolve into solution all or part of the gamma prime in the gamma matrix, and then reprecipitating the gamma prime by cooling the alloy from its solution temperature. The ability to optimally heat treat single crystal alloys is a function of the difference between the alloy's incipient melting temperature and the gamma prime solvus temperature. Tests to determine the melting temperature of Alloy 610A indicated that when exposed to temperatures up to 2500° F., there was no incipient melting of the specimens. Such a high melting point is uncommon in nickel base superalloys, and makes the alloy suitable for use in the high temperature section of a gas turbine engine. Further tests indicated that Alloy 610A had a gamma prime solvus temperature of 2,485° F. Thus, since the difference between the incipient melting temperature and the gamma prime solvus is at least 15°, all of the gamma prime phase can be dissolved into solution by heat treatment without any melting of the alloy. Tests conducted on Alloy 610 revealed that the gamma prime solvus temperature was slightly greater than the incipient melting temperature, which was 2510° F. While this may preclude complete solutioning of the gamma prime phase, the alloy can be heat treated at temperatures to cause partial solutioning of the gamma prime; upon cooling from the solutioning temperature, a desired amount of the gamma prime phase will preciptate.

In both Alloy 610 and Alloy 610A, the gamma prime phase typically has a cuboidal shape; the average gamma prime phase size (cube edge dimension) in the heat treated single crystal article should be less than about 0.5 microns for optimum mechanical properties. In order to achieve such a microstructure, single crystal articles having the composition of the present invention should be solution heat treated at about 2,500° F. for 4 hours, cooled to about 2,100° F. at a rate of at least 115° F. per minute, and cooled to room temperature at a rate equal to or faster than air cool. The articles should then be given an aging heat treatment at about 1,600° F. for 32 hours.

It is believed that the desirable properties of the alloys of the present invention are due to the unique combination of the alloying elements Al, Ta and Re, and the metallurgical interaction between them. This produces an alloy which has surprisingly good oxidation and corrosion resistance, and an unusually high melting point. Preferably, the combined Al+Ta+Re content should be at least 21 weight percent; most preferably it is between 24 and 26 weight percent. It is seen in Table I that the alloys of the present invention may contain small levels of the elements B, Cb, Zr and/or C. While neither of the preferred Alloys 610 or 610A contain such elements, they may be present in such minor amounts.

It should be understood by those skilled in the art that other various changes and omissions in the form and detail of the invention may be made without departing from the spirit and scope thereof.

We claim:

1. A heat treated single crystal nickel base superalloy article, consisting essentially of, by weight percent, 4.5–5.5 Al, 3.5–6.5 Re, 13–17 Ta, up to 0.5 Hf, up to 1 Cr, up to 0.2 Ti, up to 1 W, up to 0.2 Mo, up to 0.01 B, up to 0.01 Zr, up to 0.2 Cb, up to 0.05 C, with the balance Ni.

2. The article of claim 1, having an average gamma prime particle size less than about 0.5 microns.

3. The composition of claim 1, having an incipient melting temperature of at least 2500° F.

4. A chromium and cobalt free, oxidation and hot corrosion resistant single crystal nickel base superalloy article, consisting essentially of, by weight percent, about 4.5–5.5 Al, about 3.5–6.5 Re, about 13–17 Ta, up to about 0.5 Hf, with the balance nickel.

5. The article of claim 4, consisting essentially of, by weight percent, about 5 Al, about 4 Re, about 16 Ta, with the balance nickel.

6. The article of claim 4, consisting essentially of, by weight percent, about 5 Al, about 6 Re, about 14 Ta, about 0.1 Hf, with the balance nickel.

* * * * *

UNITED STATES PATENT AND TRADEMARK OFFICE

CERTIFICATE OF CORRECTION

PATENT NO. : 4,888,069

DATED : December 19, 1989

INVENTOR(S) : David N. Duhl et al.

It is certified that error appears in the above-identified patent and that said Letters Patent is hereby corrected as shown below:

In CLAIM 1:

On line 34, after "Cr," and before "up to 0.2 Ti,"
add --up to 1 Co,--

Signed and Sealed this

Sixth Day of November, 1990

*Attest:*

HARRY F. MANBECK, JR.

*Attesting Officer*

*Commissioner of Patents and Trademarks*